US007404421B2

(12) United States Patent
Guels

(10) Patent No.: US 7,404,421 B2
(45) Date of Patent: Jul. 29, 2008

(54) BLADE HOLDER, BLADE AND BLADE TOOL HEAD

(76) Inventor: Martin Guels, Karnsberg 2, Murrhardt (DE) 71540

( * ) Notice: Subject to any disclaimer, the term of this patent is extended or adjusted under 35 U.S.C. 154(b) by 0 days.

(21) Appl. No.: 10/527,065

(22) PCT Filed: Sep. 9, 2003

(86) PCT No.: PCT/EP03/10000

§ 371 (c)(1),
(2), (4) Date: Feb. 9, 2006

(87) PCT Pub. No.: WO2004/024408

PCT Pub. Date: Mar. 25, 2004

(65) Prior Publication Data

US 2006/0151064 A1 Jul. 13, 2006

(30) Foreign Application Priority Data

Sep. 9, 2002 (DE) ..... 102 42 336

(51) Int. Cl.
*B27C 1/00* (2006.01)

(52) U.S. Cl. ..... 144/220; 144/218; 407/46

(58) Field of Classification Search ..... 144/176, 144/218, 220, 235; 409/34, 40, 43, 46, 48, 409/55, 58; 407/34, 40, 43, 46, 48, 55, 58
See application file for complete search history.

(56) References Cited

U.S. PATENT DOCUMENTS 5,271,442 A 12/1993 Carpenter et al.
5,505,239 A 4/1996 Spark
5,511,597 A * 4/1996 Shantie et al. ..... 144/220
5,709,255 A 1/1998 Toogood
RE36,659 E 4/2000 Toogood
6,502,609 B1 * 1/2003 Guels ..... 144/176
2002/0043297 A1 4/2002 Luecke et al.

FOREIGN PATENT DOCUMENTS

DE 1 955 137 6/1971
DE 198 16 164 A1 4/1998
DE 198 58 740 C 6/2000

OTHER PUBLICATIONS

German Office Action dated Apr. 30, 2003 (Two (2) pages).
International Search Report, Jan. 7, 2004.

* cited by examiner

*Primary Examiner*—Shelley Self
(74) *Attorney, Agent, or Firm*—Crowell & Moring LLP

(57) ABSTRACT

A blade, blade holder, and blade tool head is provided. The blade holder includes a mounting surface for a cleaver and an adjacent inclined mounting surface for a flat blade and blade fixing elements for detachably fixing the blades to their mounting surfaces. The blade mounting surfaces have holder contact surfaces with a V-shaped cross-section, and the blade fixing elements directly fix the blades, each of which has corresponding inclined V-shape contact surfaces, to their respective mounting surface, with a retaining force that acts between the inclined V-shaped contact surfaces. The blade has on its lateral side an oblique bearing region, which permits both blades to lie flat against one another.

12 Claims, 4 Drawing Sheets

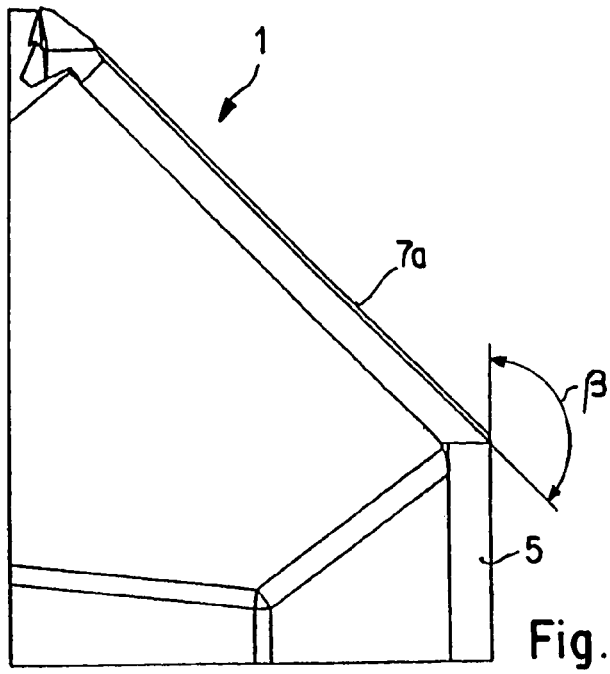
Fig.3
Fig.4
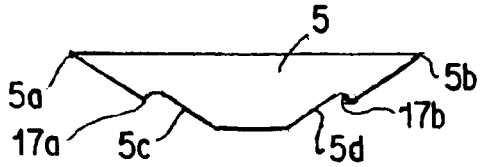
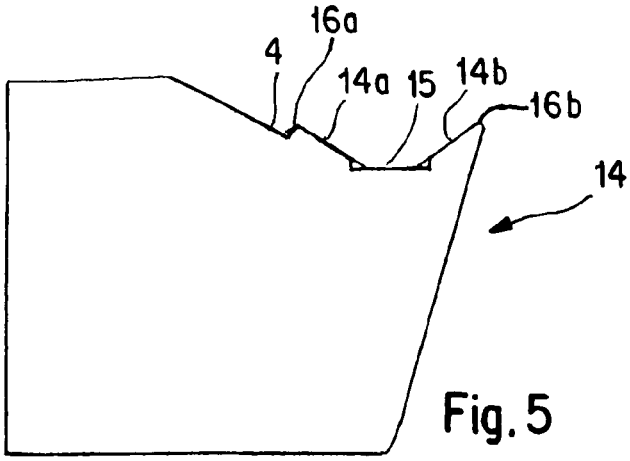
Fig.5

BLADE HOLDER, BLADE AND BLADE TOOL HEAD

This is a National Phase Application based on PCT/EP2003/010000, filed Sep. 9, 2004 and claims the priority of German Application 102 42 336.9, filed Sep. 9, 2002 the disclosure of which is expressly incorporated by reference herein.

BACKGROUND AND SUMMARY OF THE INVENTION

This invention relates to a knife holder for a knife tool head that can be assembled with chipping knives on the periphery and slabbing knives on the ends, where the knife holder has a mounting face for a chipping knife and an adjacent mounting face inclined to the former for a slabbing knife and knife mounting means for detachable mounting of the chipping knife and the slabbing knife on the respective mounting face; this invention also relates to a respective knife and a knife tool head having a base body in the form of a truncated cone or a cylinder and multiple knife holders attached thereto with one or more knives mounted on each.

Such knife tool heads are used, for example, for chipping wood, in particular for chipping the lateral segments of logs in profile chippers and choppers in the production of wood chips for papermaking. Chipping knives are used primarily to produce the useful chips, while the slabbing knives, also known as planing knives, serve primarily to produce a flat smooth surface on the remaining wood material.

U.S. Pat. Nos. 5,271,442 and 5,709,255 disclose generic knife holders designed in a U shape with a base plate that is provided with boreholes for screwable attachment to the lateral surface of an essentially cylindrical base body of the tool head. A buckling U-shaped section that is elevated from the base plate supplies the two mounting faces for the chipping knife and the slabbing knife, namely as planar surfaces provided with boreholes. Turning knives are used as the chipping knives and slabbing knives; each knife is secured between a respective carrier, which is in contact with the respective mounting face of the holder, and an outer clamping piece. For assembly, the carrier is first screwed to the mounting face of the holder, and then the chipping knife or slabbing knife is placed on top of that and next the clamping piece is applied and attached to the holder with screws at fastening points at the side next to the knife, with the screws passing through through-bores in the carrier.

Another generic knife holder is disclosed in Unexamined German Patent DE 198 16 164 A1, wherein chipping knives and slabbing knives are secured on the holder and clamped in the same way using a clamping piece and a carrier. The knife holder there has a flange with a dovetailed cross section with which it can be secured on a hub element that functions as the base body of the tool head. The hub element in the form of a cylindrical ring therefore has flattened areas on the outer lateral surface with longitudinal grooves introduced into them, so that a knife holder with its flange can be inserted axially into each longitudinal groove and secured there.

The chipping knives and slabbing knives of the turning knife type used with the generic knife holders mentioned above have a rectangular basic shape, i.e., their transverse and/or narrow sides run in planes perpendicular to the longitudinal edge knife cutting edges. In application cases in which the longitudinal axes of the chipping knife and slabbing knife are in different planes, i.e., in which the chipping knife leads or trails behind the slabbing knife in the direction of rotation of the tool head, the chipping knife and the slabbing knife are in mutual contact on their facing ends of the free active knives only at some points when in the new state. Due to wear and in particular due to regrinding of the knife cutting edges, the case may therefore occur when the point contact of the active knife cutting edges of the chipping knife and the slabbing knife are lost, the result being a continuous gap between the chipping knife and the slabbing knife, which can become clogged with wood fibers or chips in an undesirable manner during operation.

German Patent DE 198 58 740 C1 describes mounting a knife on a knife holder which has a mounting face with holder contact faces that are inclined in a V-shaped cross section, where the knife is in contact with corresponding inclined knife contact faces in a V-shaped cross section. The knife is held directly on the knife holder and thus without the use of clamping pieces due to the respective knife mounting means with a holding force that acts in the area between the contact faces, which are inclined in a V shape.

This invention is based on the technical problem of providing a knife holder which can be assembled with chipping knives on the periphery and slabbing knives on the end face, a knife for this holder and a respective knife tool head which will jointly permit secure, self-centering holding of one chipping knife and one slabbing knife jointly on a holder without any play. This holder can in turn be secured on the tool head and allows relatively simple replacement of the knives without any complex adjustment work, whereby the chipping knife and the slabbing knife can also be mounted on the holder with the knives in close proximity even in the reground state if necessary.

With the inventive knife holder, the two mounting faces for the chipping knife and the slabbing knife each have holder contact faces that are inclined to form a V-shaped cross section, and direct fastening means are provided as the knife mounting means, securing the chipping knife and the slabbing knife, each having knife contact faces forming a corresponding V shape, directly on the respective holder contact face with a holding force acting between the contact faces that are inclined in a V shape.

The line of action of the holding force for the chopping knife as well as that of the slabbing knife are each in the angle range spanned by the contact faces inclined in a V shape, so that a self-centering effect of the two knives when secured on the knife holder is obtained due to the effect of the holding force. The centered position is unambiguously defined for each of the two knives by the pairs of cooperating contact faces inclined in a V shape and opposing one another with respect to the line of action of the holding force. The holding force which acts in this way also results in a uniform force distribution on these contact faces and thus on the whole in a favorable uniform fastening force acting on the respective knife and the knife holder. These characteristic properties of direct holding of the chipping knife and the slabbing knife on a common holder consequently ensure a secure mounting of the chipping knives and the slabbing knives on the tool head without any play even under load during chipping operation and thus permit a rapid and easy mounting of the knives with a high repeating accuracy of the knife position on insertion of a new knife without requiring complex adjustment work.

With the inventive knife holder, the chopping knife and the slabbing knife are attached directly to the respective mounting face and the holding body is designed as a one-piece part and can in turn be attached directly to the knife tool head. Consequently, this permits very simple mounting of the chopping knife and the slabbing knife onto a joint one-piece holder body and dismantling it therefrom as well as mounting the holder body on and/or dismantling it from the knife tool head with direct fastening means without additional parts.

In an advantageous embodiment of this invention, the direct fastening means consist of a single screw connection for the slabbing knife and one or two screw connections for the chipping knife. Beyond this, no additional fastening parts such as clamping pieces or the like are necessary.

Advantageous positioning of chipping knife and slabbing knife in relation to one another is provided by an embodiment in which there are corresponding angle ranges which describe the relative position of the cutting edges of the chipping knife and slabbing knife.

In a further refinement of this invention, holder fastening means for the knife holders are provided laterally next to the mounting faces for the knives. In this way the holders can be mounted on the tool head without being hindered by the knives and dismantled from it again without having to remove the knives from the holder.

Another embodiment of the inventive knife is designed so that it has one or two inclined contact areas on at least one transverse side, these contact areas extending from one end of the knife cutting edge with a slope that corresponds to a corresponding inclined angle of the relative position of the peripheral knives and the slabbing knives on the holder, so that when the knife is mounted on the holder as a chipping knife or as a slabbing knife, it is in contact with the other knife not only with spot contact but instead with linear or area contact with this area. The chipping knife and slabbing knife may be provided with the corresponding slopes or the slope may be provided completely on one knife, in which case the other knife then has a transverse edge perpendicular to the knife cutting edge. The linear or surface abutment of the two knives in an area in contact with the active cutting edges yields the advantageous effect that the two knives are always in mutual contact without any essential gap on their active knife cutting edges even in a used, reground state, so that there is no unwanted clogging or jamming of chipped material between the two knives in the meantime.

With another embodiment of the inventive knife tool head, multiple inventive knife holders are distributed on the circumference of a base body in the form of a truncated cone. They are inserted here in the respective holder receptacles, where the chipping knives point toward the lateral surface of the truncated cone of the base body and the slabbing knives point toward the end face of the base body.

In a further refinement of this invention, multiple second knife holders are provided on the lateral surface of the base body of the tool head in the form of a truncated cone behind said inventive knife holders, each being assembled with a chipping knife and a slabbing knife, and are offset with respect to these in the circumferential direction, whereby the second knife holder is assembled with only one chipping knife. It is found that the knife tool head designed in this way fulfills very well the cutting function as well as the smoothing function.

In another embodiment of this invention, the knife tool head is assembled with two different types of inventive knife holders which differ in chipping knives of different lengths. The two different types of knife holders are arranged in a preselectable regular sequence in the circumferential direction of the tool head base body. Here again, it is found that such a knife tool head fulfills very well the functions of chipping and smoothing at the same time, as expected of it.

In a further embodiment, the slabbing knives of two or more knife holders mounted on the tool head sequentially in the direction of rotation are arranged with slabbing knives and chipping knives in planes that are offset axially in relation to one another. This yields a certain desired chip thickness according to the axial spacing between such successive slabbing knives.

Other objects, advantages and novel features of the present invention will become apparent from the following detailed description of the invention when considered in conjunction with the accompanying drawings.

BRIEF DESCRIPTION OF THE DRAWINGS

FIG. 3 shows a side view of the holder from FIG. 1, FIG. 4 shows an end view of the slabbing knife for the holder from FIGS. 1 through 3, FIG. 5 shows a side view of a holder according to FIGS. 1 and 2 in the longitudinal direction of the slabbing knife but for a counterclockwise chipping knife tool head with the slabbing knife removed.

DETAILED DESCRIPTION

Figure 1:
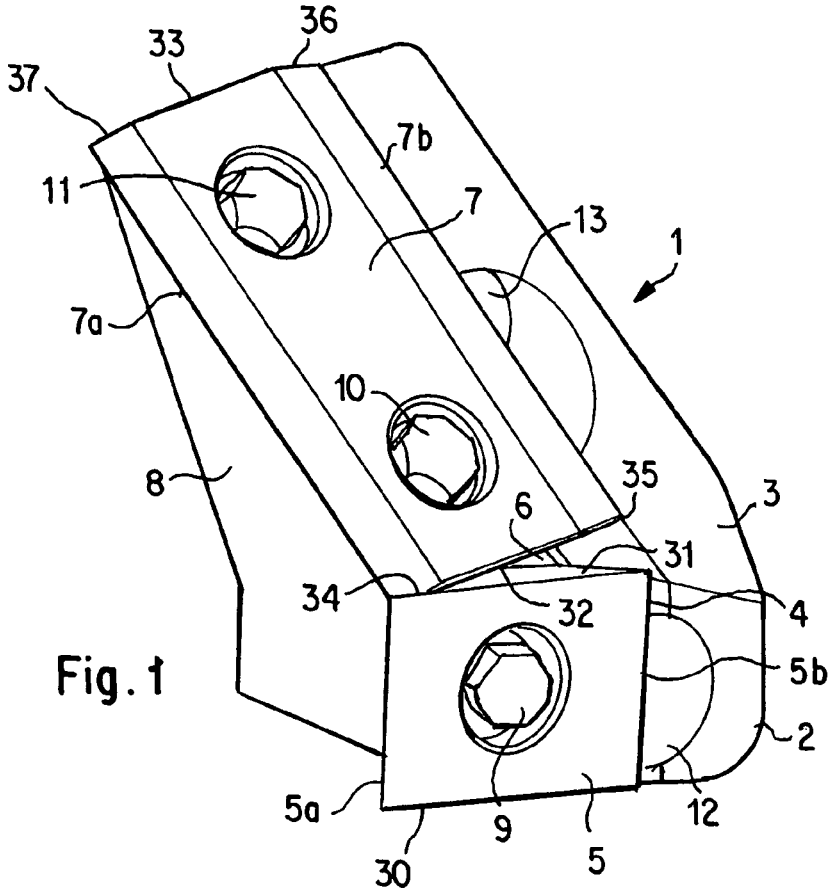
FIG. 1 shows a perspective view of a knife holder with slabber and chipping knives for a clockwise chipping knife tool head in accordance with an embodiment of the present invention.
Figure 2:
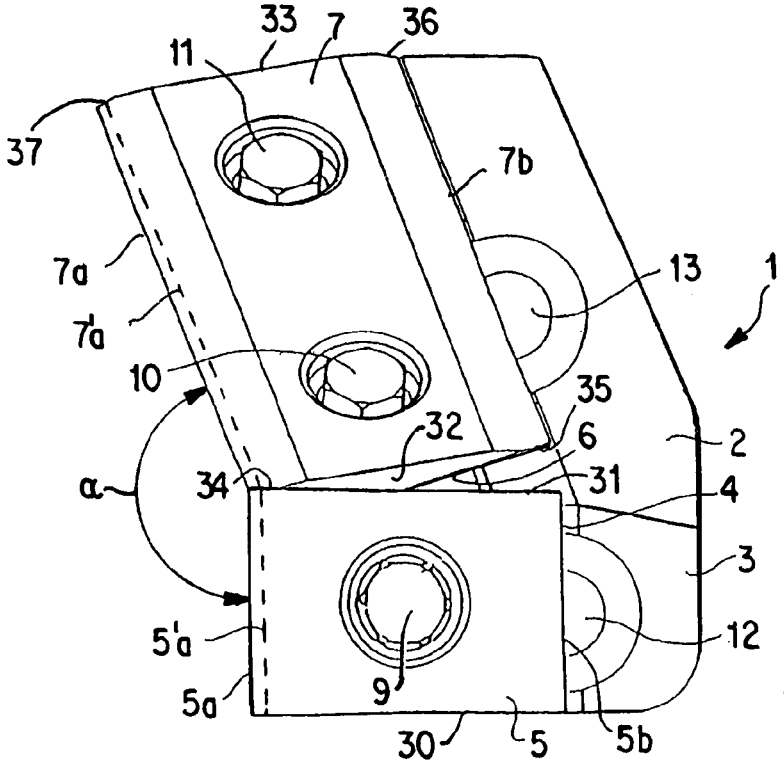
FIG. 2 shows a top view of the holder from FIG. 1 in the direction perpendicular to the plane of the slabbing knife.

FIGS. 1 through 3 show a knife holder for a counterclockwise knife tool head. The knife holder consists of a one-part solid metal holder body 1 having the shape indicated in FIGS. 1 through 3. The forward holder body face in FIGS. 1 and 2 includes a smaller first face area 2 and a larger second face area 3 which is inclined with respect to the former. A left part (in FIGS. 1 and 2) of the first face area 2 is designed as a mounting face 4 on which a slabbing knife 5 is mounted. A left part (in FIGS. 1 and 2) of the second face area 3 is designed as a mounting face 6, which is in contact with the mounting face 4 and on which a chipping knife 7 is mounted.

Turning knives each with two opposing cutting edges 5*a*, 5*b* and/or 7*a*, 7*b* are used as the slabbing knives and chipping knives 5, 7, whereby the slabbing knife 5 has a rectangular base shape with transverse sides 30, 31 perpendicular to the longitudinal-side knife cutting edges 5*a*, 5*b* and positioned on the holder body 1 so that it is largely parallel with its knife plane to the end face of the tool head when the holder body 1 is attached to the tool head. The chipping knife 7, also referred to as the peripheral knife, extends with its plane of the knife essentially on the circumference of the tool head when the holder body 1 is mounted on the tool head. It has an elongated, essentially rectangular base shape, but it is sloped over a certain extent in contact with the cutting edges 7*a*, 7*b* on its four corner areas on the transverse sides 32, 33, forming corresponding surface-area contact areas 34 to 37.

As shown in FIGS. 1 and 2, the two knives 5, 7 are in contact at the ends with their free active knife cutting edges 5*a*, 7*a* or at any rate there is only a very slight distance between them. Chips released by these knife cutting edges 5*a*, 7*a* during operation can be diverted via the adjacent side 8 of the holder body 1 functioning as a baffle. The angle values in the two different views in two mutually perpendicular directions according to FIGS. 2 and 3 define the mutual spatial positions of the slabbing knife 5 and the chipping knife 7, in particular the mutual spatial positions of their effective free cutting edges 5*a*, 7*a*. In the horizontal projection in FIG. 2 perpendicular to the plane of the slabbing knife 5, the effective cutting edges 5*a*, 7*a* of the slabbing knife 5 and the chipping knife 7 form an angle $\alpha$ which amounts to approx. 159° in the example shown here and may have a different value between 130° and 230° as needed in the alternative exemplary embodiments. This angle $\alpha$ determines whether and to what extent the chipping knife 7 leads or lags behind the slabbing knife 5 in the direction of rotation of the tool head. The angle $\beta$, which is shown in FIG. 3 in a projected view parallel to the chipping knife plane indicates how steep the chipping knife is with respect to the plane of the slabbing knife, and thus the end face of the tool head. In the example shown here, the angle $\beta$ amounts to approximately 135° and in alternative exemplary embodiments it may assume values between 80° and 180°, as needed.

As FIGS. 1 and 2 also show, the slopes of the chipping knife contact areas 34, 35, 36, 37 are coordinated with the relative position of the chipping knife 7 in relation to the slabbing knife 5, so that with the contact area 34, which, when the knife is mounted, is in contact with the active cutting edge 7*a* and is facing the slabbing knife 5, the chipping knife 7 is in at least linear contact with the slabbing knife 5 and not just in a point. This has the advantage that the chipping knife 7 and the slabbing knife 5 are in contact with one another without a gap between their two active cutting edges 7*a*, 5*a* when their active cutting edges 7*a*, 5*a* have already worn away somewhat in comparison with the new state and/or they have already been shortened somewhat in the depth of the cutting knife due to regrinding. For the sake of illustration, FIG. 2 shows such a shortened reground cutting edge shape 5'*a*, 7'*a* shown with dotted lines. It can be seen here that the transition between the slabbing knife 5 and the chipping knife 7, which is more or less without any gaps, is completely retained as a result of this measure. The slope of the respective chipping knife contact area 34 through 37 is coordinated first with the forward and/or reverse angle $\forall$ as shown in FIG. 2 and secondly with the chipping knife pitch angle $\exists$ as shown in FIG. 3, so that the chipping knife 7 is even in area contact with the slabbing knife 5 over the respective contact area 34.

The slabbing knife 5 is detachably attached to the slabbing knife mounting face 4 of the holder body 1 by means of a single central screw connection 9. The slabbing knife mounting face 4 of the holder body 1 has profiling with two holder contact faces inclined in a V-shaped cross section against which the slabbing knife 5 is in contact with two corresponding knife contact faces inclined toward one another in a V shape, as explained in greater detail below with respect to the exemplary embodiment shown in FIGS. 4 through 7. The holder contact faces and knife contact faces which are inclined toward one another in a V shape form an angle of preferably less than 130°, e.g., approximately 110°. The V angle formed by the knife contact faces that are inclined in a V shape is preferably somewhat smaller than the V angle formed by the holder contact faces, so that in mounting, the slabbing knife with its contact faces comes to rest at first primarily against the outer end areas of the V legs against the mounting face 4 and then is pressed with a self-centering effect into the V-shaped receptacle formed by the contact faces of this mounting face 4 under the influence of the fastening screw 9.

Similarly, the chipping knife 7 is secured by means of two fastening screws 10, 11 on the respective mounting face 6 (having a profiling with two holder contact faces inclined to form a V-shaped cross section) of the holder body 1, against which corresponding knife contact faces, provided on the backs of the chipping knives and inclined in a V shape, are in centering contact. The V-profiling runs in the longitudinal direction of the knife for the slabbing knife 5 and the chipping knife 7, i.e., running parallel to the knife cutting edges 5*a*, 7*a*. The fastening screws and thus the lines of influence of these fastening means extend between the respective pair of V-shaped contact faces, so that self-centering holding forces distributed uniformly are exerted by the screw connections 9, 10, 11 on the slabbing knife 5 and the chipping knife 7. For additional details about this type of knife mounting, reference is also made to DE 198 58 740 C1, which was cited in the introduction.

In the section on the right in FIGS. 1 and 2 next to the mounting faces 4, 6 for the knife mounting, the holder body 1 is provided with two continuous bores 12, 13, each introduced into the holder body 1 at approximately right angles to the plane of the slabbing knife, whereby one bore 12 is situated in the first face area 2 and the second bore 13 is in the second face area 3. These bores 12, 13 together with respective fastening screws (not shown) form holder fastening means for securing the holding body 1 directly on the tool head. This permits a very simple means of fastening the holder on the tool head using only two screws without any interference by the slabbing knife 5 and the chipping knife 7 and without having to dismantle one of the knives 5, 7 when the holder is mounted on or dismantled from the tool head. In alternative embodiments, instead of the V-shaped contact faces, a different type of surface contact between the holder body 1 and the respective knife 5, 7 may be provided, retaining a direct fastening of a chipping knife and a slabbing knife on a one-piece holder body which is in turn attached directly to the knife tool head.

FIGS. 4 through 8 illustrate a knife holder with a one-piece holder body 14 which corresponds largely to that of FIGS. 1 through 3, but in contrast with that is designed for a counter-clockwise chipping knife tool head as well as the respective knives. In particular, the same slabbing knives 5 and similar chipping knives 7, 7' can be used for the two knife holders, and for the sake of simplicity, the same reference notation has been used for elements that are functionally similar.

FIG. 4 shows an end view of the slabbing knife 5 of the turning knife type that can be used for both knife holders with one knife cutting edge 5*a*, 5*b* for each running along the two longitudinal edges of the knife. The two knife contact faces 5*c*, 5*d* which are inclined toward one another in a V shape can be seen on the back side of the knife in FIG. 4, forming the contact faces of the slabbing knife 5 in mounting on the holder body 1, 14, as explained above.

Figure 6:
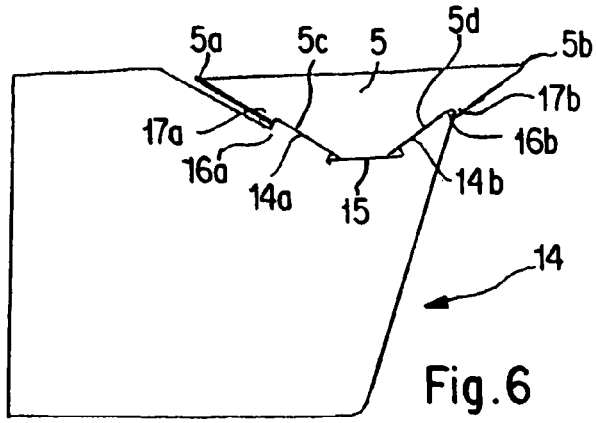
FIG. 6 shows a view from FIG. 5 with the slabbing knife mounted.

FIG. 5 shows the holder body 14 with the knives removed in a direction parallel to the front view of the slabbing knife in FIG. 4, i.e., parallel to the longitudinal axis of the slabbing knife and/or the knife cutting edges 5*a*, 5*b* when the slabbing knife 5 is mounted. FIG. 6 shows the corresponding view with the slabbing knife 5 mounted. The corresponding holder contact faces 14*a*, 14*b* inclined toward one another in a V shape can be seen clearly in FIG. 5; they are formed by corresponding profiling of the slabbing knife mounting face 4 of the holder body 14 and can be applied against the slabbing knife with its V-shaped contact faces 5*c*, 5*d* with a self-centering effect, as explained above with regard to the embodiment illustrated in FIGS. 1 through 3. The V holder contact faces 14*a*, 14*b* end toward the inside in a trough-shaped recess 15 in the end view of FIG. 5 and toward the outside they end in one shoulder 16*a*, 16*b* each. With the mounted slabbing knife 5, knife-like projections 17*a*, 17*b* extend beyond the shoulders 16*a*, 16*b* on the holder side with a centering effect and securing the position as shown in FIG. 6.

Again in this example, the slabbing knife 5 is held on the holder body 14 by means of a single central fastening screw which passes through a central borehole in the slabbing knife 5 in the area between the contact faces 5*c*, 5*d*, 14*a*, 14*b* on the knife side and the holder side and which is screwed into the holder body 14 in the trough area 15 between the two V-shaped contact faces 14*a*, 14*b* on the holder side.

Figure 7:
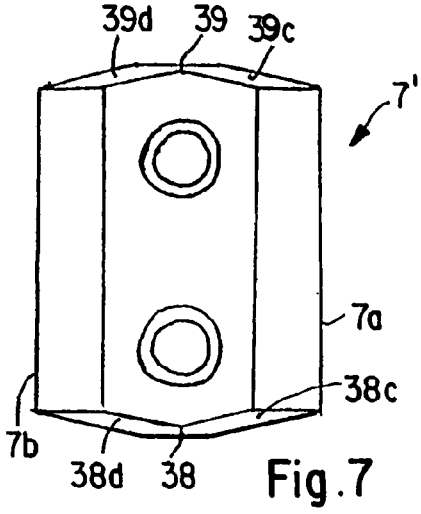
FIG. 7 shows a top view of the top side of a chipping knife used for the holder from FIG. 5.
Figure 8:
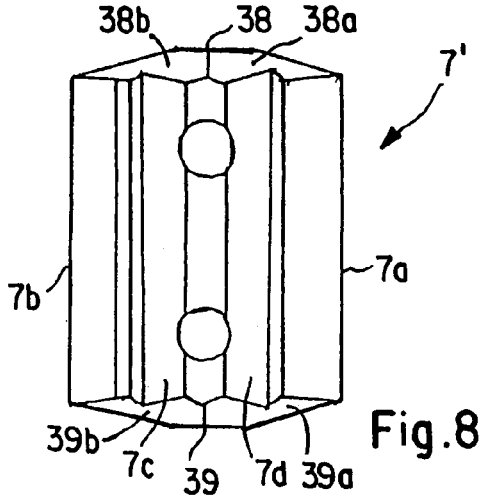
FIG. 8 shows a top view of the bottom side of the chipping knife from FIG. 7.
Figure 9:
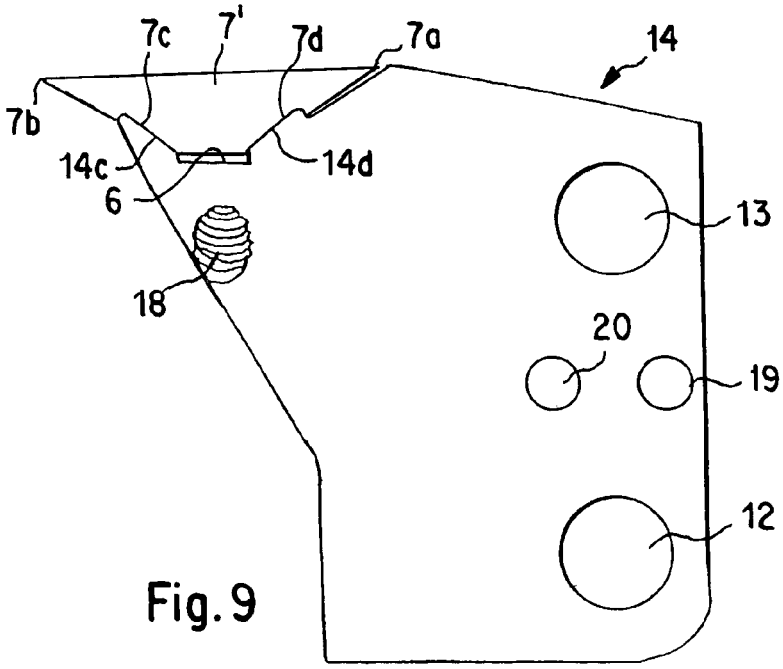
FIG. 9 shows a top view of another side face of the knife holder according to FIGS. 5 and 6 to illustrate the mounting of the chipping knife.

In the same way, a chipping knife 7', as shown in the top views of the top side and bottom side in FIGS. 7 and 8, respectively, can be mounted on the chipping knife mounting face 6 of the holder body 14, as can be seen in a respective view of the end face in FIG. 9 and as explained above with regard to the exemplary embodiment shown in FIGS. 1 through 3, which is largely identical in design. The chipping knife mounting face 6 of the holder body 14 has profiling with two holder contact faces 14*c*, 14*d*, which are inclined toward one another in a V shape, and against which two knife contact faces 7*c*, 7*d* that are inclined toward one another in a V shape correspondingly with a self-centering effect can be brought in contact.

The chipping knife 7' is also of the turning knife type with two cutting edges 7*a*, 7*b* on the longitudinal sides, as stated above, and its design corresponds largely to that shown in FIGS. 1 through 3. In contrast with the latter, the chipping knife 7' is inclined over the entire area on its two transverse sides 38, 39, as shown by the top side view in FIG. 7 and the bottom side view in FIG. 8. Specifically the chipping knife 7' has its greatest longitudinal extent at the longitudinal center, and each transverse side 38, 39 is designed to form a bottom inclined face 38*a*, 38*b*, 39*a*, 39*b* and a top inclined face 38*c*, 38*d*, 39*c*, 39*d*, with the inclined faces 38*a* through 39*d* each extending outward from the longitudinal center to the respective knife cutting edge end and from the underside of the knife or the top side of the knife to the level of the cutting knife plane, where they meet. The inclined faces 38*a*, 38*b*, 39*a*, 39*b* on the bottom side function as potential contact faces, i.e., when the chipping knife 7' is mounted, it is in contact with the contact face of the slabbing knife 5 over the full area facing the slabbing knife 5 and the active chipping knife cutting edge 7*a*.

The chipping knife 7' is therefore in contact with the slabbing knife 5 more or less without any gaps up to the height of its longitudinal center. The advantages of such contact between the chipping knife and the slabbing knife on their active knife cutting edge side, as mentioned above with regard to the exemplary embodiment illustrated in FIGS. 1 through 3, consequently also apply to the example shown in FIGS. 4 through 9 to a particular extent, where this contact is not merely in one or more points but instead is at least a line and in this example even covers a relatively large area. Even after frequent regrinding, the chipping knife 7' and the slabbing knife 5 are still in mutual contact without any gaps along their active knife cutting edge after being mounted on the holder body 14, so that no chipped wood product can penetrate into the gap or become lodged there.

In alternative embodiments, the slope of the knife which is implemented only in the areas shown here on the chipping knife and which leads to the linear and/or area contact of the two knives on the holder may also be provided on the slabbing knife instead of on the chipping knife. In other alternative exemplary embodiments, the slope may also be distributed between the two knives, i.e., the chipping knife and the slabbing knife are provided with corresponding slopes in this contact area, so that they are in linear or surface contact with one another without any gaps after mounting.

The chipping knife is mounted as described in the exemplary embodiment according to FIGS. 1 through 3 by two fastening screws which pass through the chipping knife 7' with a distance between them at the longitudinal center and in the longitudinal direction of the chipping knife and are screwed into threaded bores, which are provided in the trough area between the holder contact faces 14*c*, 14*d* in the holder body 14, one threaded bore 18 being visible in FIG. 9.

In addition, FIG. 9 shows on the back the two holder fastening bores 12, 13 which are situated laterally next to the mounting faces 4, 6 for the slabbing knife 5 and the chipping knife 7' in the holder halves and serve to accommodate two fastening screws with which the holder body 14 can be detachably attached directly to a base body, e.g., in the form of a truncated cone, of the knife tool head without hindrance due to the two mounted knives 5, 7'. Two blind holes 19, 20 function as centering holes for mounting the holder on the tool head base body.

Figure 10:
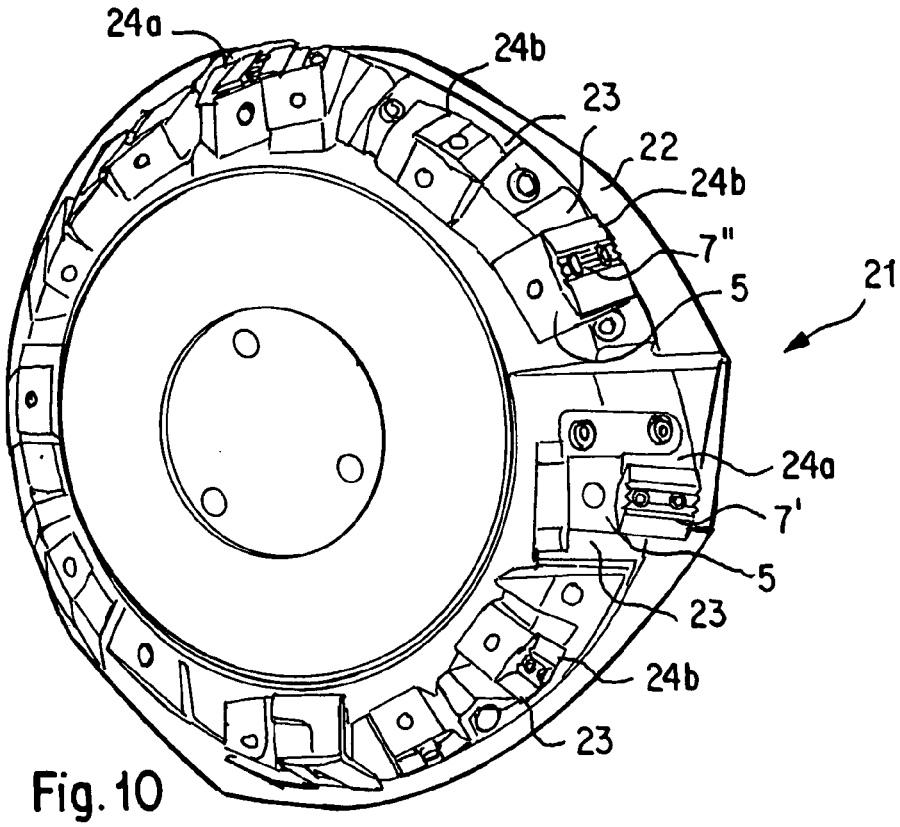
FIG. 10 shows a perspective view of a counterclockwise chipping knife tool head with knife holders according to the type shown in FIGS. 5 through 7 using two types of chipping knives of different lengths.
Figure 11:
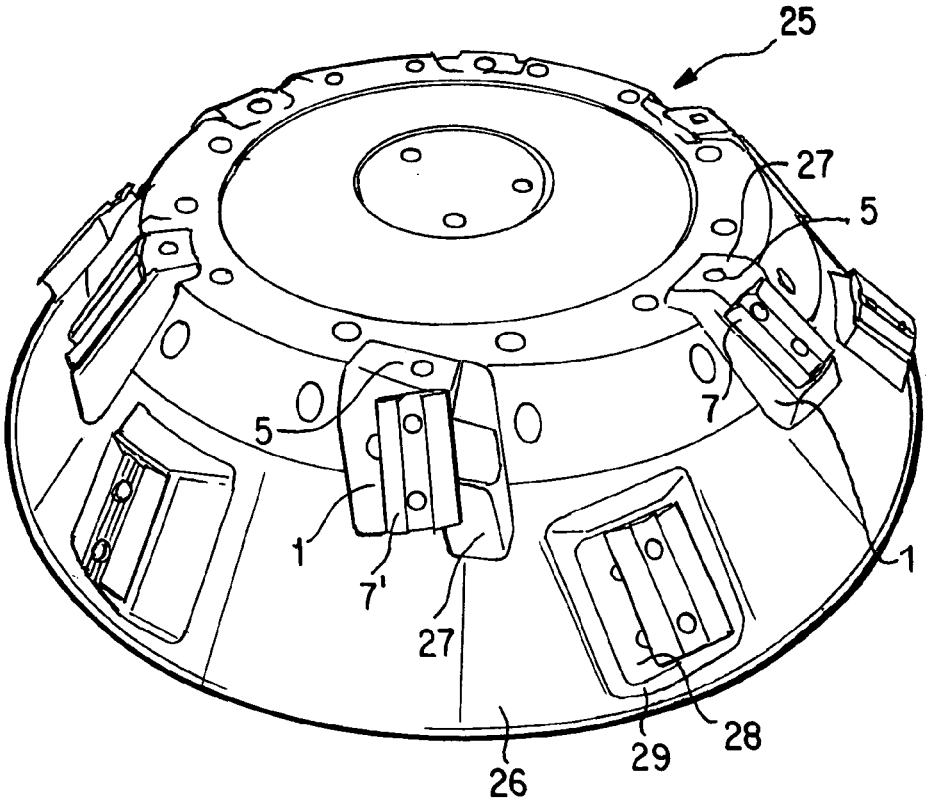
FIG. 11 shows a perspective view of a clockwise chipping knife tool head with knife holders according to FIGS. 1 through 3 and other knife holders assembled only with chipping knives.

FIGS. 10 and 11 show two exemplary embodiments of the inventive knife holder. FIG. 10 shows a counterclockwise chipping knife tool head 21 with a base body 22 in the form of a truncated cone, with receptacles 23 distributed around the surface and in contact with the end face, such that one knife holder 24*a*, 24*b* can be inserted into each receptacle. Two different knife holder types 24*a*, 24*b* are used, each having a slabbing knife 5 and a chipping knife 7', 7", where the chipping knives 7', 7" differ in length. The one type of knife 24*a* corresponds essentially to the knife holder of FIGS. 4 through 7 with the slabbing knife 5 on the end side and the chipping knife 7' on the peripheral side; the other type of knife holder 24*b* has the same slabbing knife 5 but has a shorter chipping knife 7" having approximately the same length as the slabbing knife 5.

Along the circumference of the tool head base body 22, two holders 24*b* of the type with the short chipping knife 7" alternate with a holder 24*a* of the type with a long chipping knife 7'. The slabbing knives 5 of the respective two successive holders 24*b* with the short chipping knife 7" are arranged in axially offset planes, such that the forward slabbing knife in the direction of rotation is situated approximately at the height of the end face of the tool head 21, and the following slabbing knife is offset axially toward the rear by a certain amount. With this arrangement, a defined chip thickness can be achieved according to the axial spacing of the slabbing knives. It is self-evident that any other desired sequence of the two holder types 24*a*, 24*b* with different chipping knives 7', 7" may be provided as needed.

FIG. 11 shows a clockwise chipping knife tool head 25 with a base body 26 in the form of a truncated cone provided with recesses 27 on the end side adjacently on the peripheral side, so that the knife holders of the knife holder type having the holder body 1 according to FIGS. 1 through 3 are inserted into these recesses. The slabbing knives 5 face the end side of the tool head 25; the chipping knives 7' face the lateral surface of the truncated cone shape of the base body 26.

Specifically in this example, six knife holders 1 are distributed uniformly over the circumference on the base body 26.

Axially behind them there is a second row of six knife holders 28 in the circumferential direction, mounted in the respective receptacles 29 on the lateral surface of the truncated cone shape of the base body 25. These knife holders 28 are arranged so they are offset in the circumferential direction centrally with respect to the forward knife holders 1. In other words, in the circumferential direction there is a knife holder 28 which is at the rear axially and centrally between two knife holders 1 that are at the front axially. The rear knife holders 28 are each assembled with only one chipping knife 7' which corresponds in shape and in type of fastening to the chipping knives 7' of the forward knife holders 1.

In its design with the stepped slabbing knives and the combination of short and long chipping knives, the tool head 21 in FIG. 10 covers the most common application cases of required chipping depths, but the tool head 25 in FIG. 11 is especially suitable for greater chipping depths that go beyond the former. The greater chipping depth is accomplished by the rear knife holders 28, which are mounted on the circumference, each carrying only the chipping knife 7'.

It can be seen that the desired chipping and smoothing functions are fulfilled very well with the chopping knife tool heads shown in FIGS. 10 and 11. The knife holders with their one-piece holder bodies are very easily directly mountable on the tool head base body and dismountable therefrom. Likewise, the slabbing knives and the chipping knives are each very easily mounted directly on their holders and dismantled from them as explained above. Due to the arrangement of the slabbing knife or planing knife and the chipping knife or circumferential knife on a common holder, a good and precise flow of chips is achieved. The knife as well as the holder are each attached by direct fastening means, preferably screws, without additional clamping elements, which permits a secure hold and a very compact design. The chipping knives are designed so that they can be used on both sides, i.e., on a clockwise knife tool head and a counterclockwise knife tool head.

The knife holders are suitable in particular for mounting on conical or disk-shaped milling or chipping heads in wood processing. The chipper heads may be designed so that the knife holders are arranged in various stages from the flat surface outward to produce a defined chip thickness. These steps cover the range of the most common chip cutting depths. Greater chip cutting depths are then achieved by a knife holder with a long chipping knife, where the chip thickness here tends to be more random. However, this case does not occur frequently, with a proper design of the tool head and therefore does not significantly influence the quality of the chips. It is self-evident that this invention is suitable not only for processing wood by chipping but also for all other applications for knife tool heads. In all cases it is advantageous that chipper knives and slabbing knives can be mounted jointly and directly on a holder body, preferably designed in one piece, e.g., in contact with the V-shaped contact faces, and the holder body can in turn be attached directly to the knife tool head.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. Knife holder for a knife tool head for holding chipping knives on a periphery face and slabbing knives on an end face, comprising:

a holder body with a mounting face for a chipping knife and an adjacent mounting face for a slabbing knife adjacent thereto and with an inclination; and means for detachable mounting of the chipping knife on the chipping knife mounting face and the slabbing knife on the slabbing knife mounting face, wherein both holder body mounting faces have holder contact faces which are inclined with respective V-shaped cross sections, and the means for detachable mounting fasten the chipping knife and the slabbing knife directly on the knives' respective holder body mounting faces, the chipping knife and the slabbing knife each having knife contact faces inclined in a V shape and arranged such that when mounted on the knives' respective holder body mounting faces, the knives' contact faces abut one another along the knives' respective inclined V shape contact faces such that no gap is formed between the contact faces as the knives' cutting edges wear.

2. Knife holder as claimed in claim 1, wherein the holder body is designed as a one-piece part and means are provided for directly attaching the holder body on the knife tool head.

3. Knife holder as claimed in claim 1, wherein the means for detachable mounting include a single screw connection for the slabbing knife and one or two screw connections for the chipping knife.

4. Knife holder as claimed in claim 1, wherein an angle formed by cutting edges of the chipping knife and the slabbing knife in a horizontal projection of the slabbing knife is between 130° and 230°.

5. Knife holder as claimed in claim 1, wherein an angle formed by cutting edges of the chipping knife and the slabbing knife in a side projection of the slabbing knife is between 80° and 180°.

6. Knife holder as claimed in claim 1, wherein holder fastening means are provided laterally next to at least one of the knife mounting faces of the knife holder for attaching the knife holder on the knife tool head.

7. Knife for a knife holder, comprising:

a knife having at least one knife cutting edge on at least one longitudinal side of the knife, the knife being arranged to be mounted on a knife holder for a knife tool head, said knife being mounted on the knife holder as one of a chipping knife on a periphery face and a slabbing knife on an end face, said knife holder including a holder body with a mounting face for the chipping knife and an adjacent mounting face for the slabbing knife adjacent thereto and with an inclination and means for detachable fastening of the chipping knife on the chipping knife mounting face and the slabbing knife on the slabbing knife mounting face, wherein both holder body mounting faces have holder contact faces which are inclined with respective V-shaped cross sections, and the means for detachable mounting fasten the chipping knife and the slabbing knife directly on the knives' respective holder body mounting faces, the chipping knife and the slabbing knife each having a knife contact face inclined in a V shape, wherein at least one transverse side of the knife has at least one inclined contact region extending away from the at least one knife cutting edge end, a slope of the at least one contact region being adapted such that when mounted on the knife holder as the chipping knife or as the slabbing knife, the knife's inclined contact region forms a linear or area contact with an adjacent chipping or slabbing knife's inclined contact area, such that no gap is formed between the contact faces as the knives' cutting edges wear.

8. Knife tool head, comprising:

a base body in the form of a truncated cone or cylinder; and a plurality of first knife holders mounted on the circumference of the base body, each of the first knife holders having at least one knife mounted thereon, wherein the plurality of first knife holders are distributed around the circumference of the base body, the first knife holders being inserted in respective holder receptacles with at least one knife holder holding one chipping knife and one slabbing knife, the at least one chipping knife pointing toward a lateral surface of the truncated cone shape of the base body and the at least one slabbing knife pointing toward the end face of the base body, and the first knife holders comprise a holder body with a mounting face for a chipping knife and an adjacent mounting face for a slabbing knife adjacent thereto and with an inclination and means for detachable mounting of the chipping knife on the chipping knife mounting face and the slabbing knife on the slabbing knife mounting face, wherein both holder body mounting faces have holder contact faces which are inclined with respective V-shaped cross sections, and the means for detachable mounting fasten the chipping knife and the slabbing knife directly on the knives' respective holder body mounting faces, the chipping knife and the slabbing knife each having knife contact faces inclined in a V shape and arranged such that when mounted on the knives' respective holder body mounting faces, the knives' contact faces abut one another along the knives' respective inclined V shape contact faces such that no gap is formed between the contact faces as the knives' cutting edges wear.

9. Knife tool head as claimed in claim 8, wherein a plurality of second knife holders are situated behind the first knife holders and offset in a circumferential direction defined by rotation of the tool head about an axis of symmetry of the truncated cone or cylinder shape, each second knife holder holding one chipping knife on respective holder receptacles of the lateral surface of the truncated cone or cylinder of the base body.

10. Knife tool head as claimed in claim 8, wherein the plurality of first knife holders comprise two different types of knife holders configured to hold chipping knives of different lengths, further wherein the first knife holders are arranged in a preselectable regular sequence in a circumferential direction defined by rotation of the tool head about an axis of symmetry of the truncated cone or cylinder shape.

11. Knife tool head as claimed in claim 8, wherein the slabbing knives of two or more successive holders, the two or more successive holders having chipping knives and slabbing knives and arranged on the knife tool head in a direction of rotation defined by rotation of the knife tool head about an axis of symmetry of the truncated cone or cylinder shape, are arranged in axially offset planes.

12. Knife tool head as claimed in claim 8, wherein the at least one of the chipping knife and the slabbing knife on each first knife holder has at least one knife cutting edge on at least one longitudinal side of the knife, and at least one transverse side of the knife has at least one inclined contact region extending away from a knife cutting edge end, a slope of the at least one contact region being adapted such that when mounted on the knife holder as the chipping knife or as the slabbing knife, the knife's inclined contact region forms a linear or area contact with the adjacent chipping or slabbing knife's inclined contact area which maintains substantial contact between the two knives as the knives wear.

* * * * *